United States Patent [19]

Iio

[11] Patent Number: 4,493,624

[45] Date of Patent: Jan. 15, 1985

[54] LUBRICATING OIL-SEPARATING DEVICE IN A REFRIGERANT COMPRESSOR FOR AIR CONDITIONING SYSTEMS

[75] Inventor: Masahiro Iio, Saitama, Japan

[73] Assignee: Diesel Kiki Co., Ltd., Saitama, Japan

[21] Appl. No.: 527,664

[22] Filed: Aug. 30, 1983

[30] Foreign Application Priority Data

Sep. 9, 1982 [JP] Japan ..... 57-136899[U]

[51] Int. Cl.[3] ..... F04C 18/00; F04C 29/02

[52] U.S. Cl. ..... 418/98; 418/DIG. 1

[58] Field of Search ..... 418/DIG. 1, 98; 55/423, 55/392, 440, 462

[56] References Cited

U.S. PATENT DOCUMENTS 2,176,098 10/1939 Pinto ..... 55/423

4,174,196 11/1979 Mori et al. ..... 418/DIG. 1

4,408,969 10/1983 Takada ..... 418/98

*Primary Examiner*—William R. Cline

*Assistant Examiner*—John J. McGlew, Jr.

*Attorney, Agent, or Firm*—Frishauf, Holtz, Goodman and Woodward

[57] ABSTRACT

In a refrigerant compressor for use in an air conditioning system, a lubricating oil-separating device is mounted in the discharge pressure chamber communicating with pump outlets of the pump assembly and also with the discharge port. The lubricating oil-separating device comprises a plurality of tubes vertically disposed in a direction traversing flows of compressed refrigerant. The tubes each have at least one recess formed in a portion of its peripheral surface facing downstream of the compressed refrigerant flow, and an opening formed in the recess and communicating with the interior of the tube, whereby compressed refrigerant in the form of von Kármán's vortices formed immediately downstream of the tube is introduced into the interior of the tube to thereby effectively separate the lubricating oil from the refrigerant.

10 Claims, 5 Drawing Figures

LUBRICATING OIL-SEPARATING DEVICE IN A REFRIGERANT COMPRESSOR FOR AIR CONDITIONING SYSTEMS

BACKGROUND OF THE INVENTION

This invention relates to a refrigerant compressor for compressing refrigerant circulating within an air conditioning system mainly adapted for use in vehicles, and more particularly to a refrigerant compressor of this kind which is capable of efficiently separating lubricating oil from the refrigerant in which the oil is entrained.

Vane compressors are widely used for compressing refrigerant circulating within air conditioning systems for vehicles, by virtue of their structural simplicity and high adaptability to high speed operation. In such vane compressors, an appreciable amount of lubricating oil is mixed in the refrigerant gas for lubricating and cooling of the sliding parts of the pump assembly of the compressor so as to avoid seizure of such sliding parts during high speed operation, etc. However, if the refrigerant gas contains lubricating oil in too large quantities, the evaporator and condenser of an air conditioning system fail to fully exhibit their respective functions of evaporating and condensing the refrigerant gas, resulting in a drop in the thermal efficiency of the air conditioning system. To avoid such inconvenience, conventional refrigerant compressors of this kind in general are provided with lubricating oil-separating devices arranged in their discharge pressure chambers for separating lubricating oil from the discharge refrigerant. A most diffused type of such lubricating oil-separating devices is formed by an oil-separating gauze for separating the oil from the refrigerant through collision of the refrigerant against the gauze. Besides this type, there have been proposed a variety of oil-separating devices of this kind, such as a cyclonic type, a surface tension-collecting type, and a gravity-precipitating type.

However, few of such proposed types can steadily achieve a high rate of oil separation against fluctuations in the rotational speed of the compressor or fluctuations in the discharge pressure of same, and few of them can be compact in size but can exihibit an efficient oil-separating function so as to cope with a limited mounting space within the compressor. Particularly in the collision-separating type using a gauze, etc., the oil-separating rate drops in a high rotational speed region of the compressor.

SUMMARY OF THE INVENTION

It is an object of the invention to provide a lubricating oil-separating device for use in a refrigerant compressor for air conditioning systems, which is capable of steadily performing satisfactory oil separation over a substantially whole working rotational speed region of the compressor, without being largely affected by fluctuations in the rotational speed or discharge pressure of the compressor.

It is another object of the invention to provide a lubricating oil-separating device for use in a refrigerant compressor for air conditioning systems, which can be simple in construction and compact in size, thereby being able to achieve high oil-separating efficiency.

The present invention provides a lubricating oil-separating device of the type being mounted within the discharge pressure chamber of a refrigerant compressor for air conditioning systems, for separating lubricating oil from the refrigerant gas in which the former is mixed. The device comprises a plurality of tubes substantially vertically disposed within the discharge pressure chamber, each extending in a direction traversing a flow of compressed refrigerant discharged through pump outlets of the pump assembly and flowing in the discharge pressure chamber toward the discharge port. Each of the tubes has an open lower portion, at least one recess formed in a portion of its peripheral surface facing downstream of the compressed refrigerant flow, and an opening formed in the above recess and communicating with the interior of the tube. This arrangement facilitates formation of von Kármán's vortices immediately downstream of the tube. These von Kármáns vortices gather in the recess and then are introduced into the interior of the tube through the opening to thereby effectively separate the lubricating oil from the compressed refrigerant in which the former is entrained.

The above and other objects, features and advantages of the invention will be more apparent from the ensuing detailed description taken in conjunction with the accompanying drawings.

DETAILED DESCRIPTION

The invention will now be described in detail with reference to the drawings.

Figure 1:
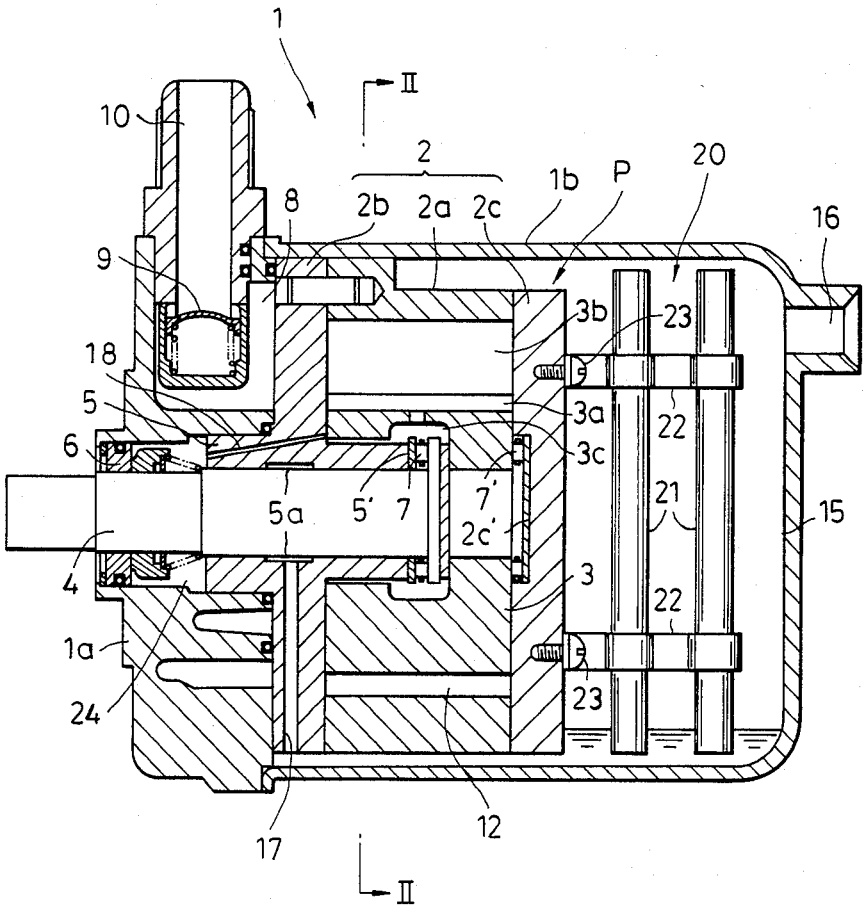
FIG. 1 is a vertical longitudinal sectional view of a vane compressure for air conditioning systems, to which is applied a lubricating oil-separating device according to an embodiment of the invention.
Figure 2:
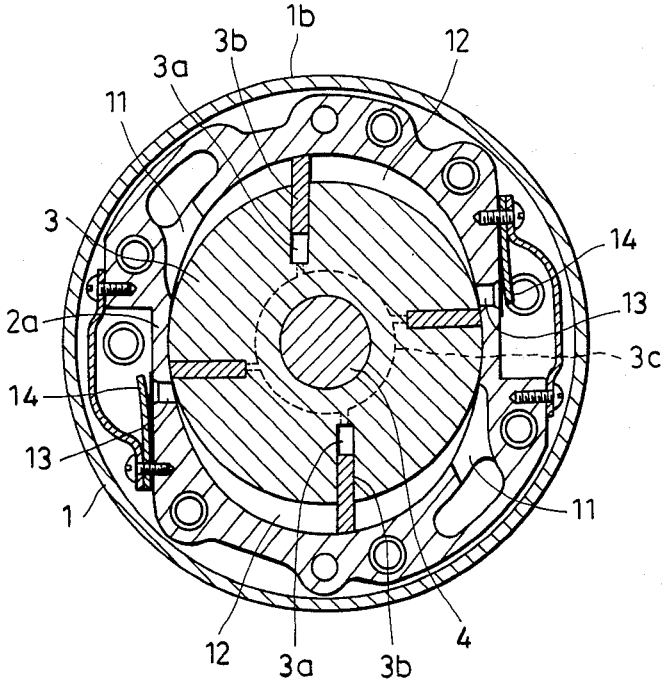
FIG. 2 is a cross-sectional view taken along line II—II in FIG. 1.
Figure 3:
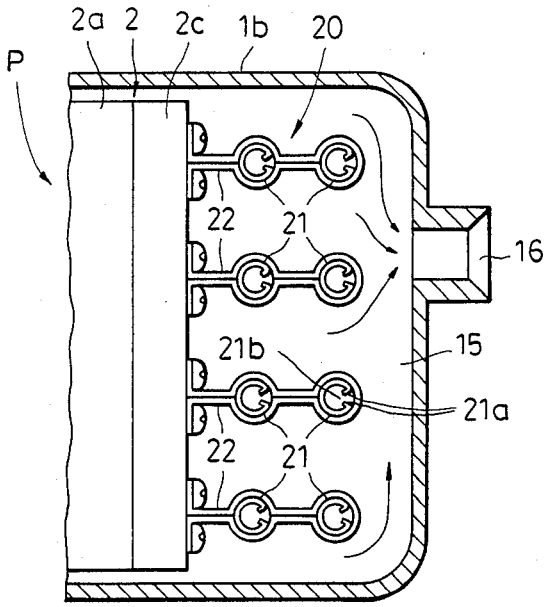
FIG. 3 is a top plan view of the lubricating oil-separating device in FIG. 1.

Referring first to FIGS. 1 through 3, there is illustrated a vane compressor for air conditioning systems, according to one embodiment of the invention. In FIG. 1, reference numeral 1 designates the main body of the vane compressor, which comprises a front head 1*a* and a cylindrical casing 1*b* joined together in a gastight manner. A pump assembly P is mounted on an inner end surface of the front head 1*a* and at the same time fitted within the casing 1*b*.

The pump assembly P is mainly composed of a pump housing formed by a cam ring 2*a* having an endless camming inner peripheral surface with an ellipsoidal cross section and front and rear side blocks 2*b* and 2*c* secured to opposite ends of the cam ring 2*a*, and a cylindrical rotor 3 rotatably received within the pump housing 2 and having its outer peripheral surface formed with four axial slits 3*a* circumferentially arranged at equal intervals and its interior formed with a back pressure chamber 3*c* communicating with the bottom of each of the axial slits 3*a*, and plate-like vanes 3*b* radially slidably fitted, respectively, in the axial slits 3*a* of the rotor 3. The rotor 3 is rigidly fitted on a drive shaft 4 at its inner end portion. The drive shaft 4, which is disposed to be rotatively driven by an output shaft of an engine for vehicles or a like prime mover, not shown, extends through the front head 1*a* and the front side block 2*b*, with its front end portion sealed by a shaft-seal means 6 mounted in the front head 1*a* and its intermediate portion journalled by an integral bearing portion 5 of the front side block 2*b*. The rotor 3 is also supported in axial or thrust-applying directions by thrust bearings 7 and 7', respectively, against an inner end surface 5' of the bearing portion 5 and an opposite inner end surface 2*c*' of the rear side block 2*c*. *A suction chamber 8 is formed within the front head 1a,* in which opens an intake port 10 provided with a check valve 9. The suction chamber 8 communicates with two of pump working chambers 12 on suction strokes, which are defined between the rotor 3, the pump housing 2 and adjacent ones of the vanes 3*b*, by way of two pump inlets 11 formed through the cam ring 2*a* of the pump housing 2. On the other hand, the other two of the pump working chambers 12 on discharge strokes can communicate with a discharge pressure chamber 15 defined within the casing 1*b* and between a rear portion of the pump housing 2 and the casing 1*b*, via two pump outlets 13 formed through the cam ring 2*a* and opened discharge valves 14 disposed to close and open the respective pump outlets 13. A discharge port 16 is formed through a rear end wall of the casing 1*b* and opens in the discharge pressure chamber 15.

The front side block 2*b* of the pump housing 2 is formed therein with a lubricating oil-feeding passage 17 extending from a lower peripheral surface of the side block 2*b* and leading to an annular groove 5*a* formed in the bearing portion 5, and also formed with an oil passage 18 extending between an internal space 24 accommodating the shaft-seal means 6 and the interior of the pump housing 2 for guiding lubricating oil to the interior of the pump housing 2, which has flown through a gap between the drive shaft 4 and the bearing portion 5 into the above internal space 24.

The illustrated vane compressor has a substantially identical construction with conventional vane compressors, insofar as it has been described above.

Figure 4:
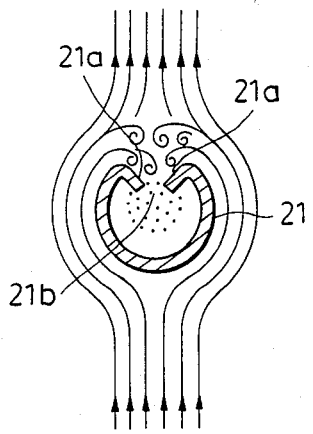
FIG. 4 is a schematic view showing how the lubricating oil is separated from the refrigerant according to the lubricating oil-separating device of the invention.

A lubricating oil-separating device 20 according to the invention is mounted within the discharge pressure chamber 15. The device 20 comprises a plurality of (eight in the illustrated embodiment) tubes 21 vertically disposed in the discharge pressure chamber 15, and stays 22 which support the tubes 21 in an embracing manner and are fixed to a rear end surface of the rear side block 2*c* by means of screws 23. The tubes 21 each extend in a direction traversing a flow of compressed refrigerant gas discharged from pump working chambers 12 on discharge strokes through the pump outlets 13 of the pump housing 2 and flowing in the discharge pressure chamber 15 toward the discharge port 16. In the illustrated embodiment, the tubes 21 are arranged in four pairs at substantially equal intervals in the transverse direction of the compressor, each pair of tubes 21, 21 being arranged axially of the compressor or along a flow of compressed refrigerant gas. As clearly shown in FIG. 4, each of the tubes 21 has open opposite ends and has a recess 21*a* formed in a rear peripheral surface portion facing downstream of the compressed gas flow and axially extending along the whole length of the tube. The recess 21*a* has its trough cut out to form an axial slit 21*b* extending along the whole length of the tube.

Next, the operation of the vane compressor constructed as above will now be explained: As the drive shaft 4 is rotatively driven by a prime mover such as an automotive engine, the rotor 3 is rotated in unison with the drive shaft 4. As a consequence, the vanes 3*b* are pushed radially outward due to centrifugal force caused by the rotation of the rotor 3 and back pressure of the lubricating oil in the back pressure chamber 3*c* introduced the bottoms of the slits 3*a* to act upon the vanes 3*b*, so that the vanes 3*b* are kept in sliding contact with the camming inner peripheral surface of the cam ring 2 while they revolve in unison with the rotating rotor 3. Each time each vane 3*b* has passed each pump inlet 11 in the cam ring 2*a*, refrigerant gas is drawn into a corresponding pump working chamber 12 through the intake port 10, the check valve 9, the suction chamber 8 and the above pump inlet 10 in succession. The pump working chamber 12 defined by adjacent vanes 3*b*, the pump housing 2 and the rotor 3 varies in volume from a minimum value to a maximum value during each suction stroke and from a maximum volume to a minimum value during each compression and discharge stroke, respectively, to thereby compress the drawn refrigerant and discharge the compressed refrigerant into the discharge pressure chamber 15 through each pump outlet 13 and its corresponding discharge valve 14 then forcedly opened. The compressed refrigerant gas thus discharged flows in the discharge pressure chamber 15 while moving across the tubes 21, and is then discharged through the discharge port 16 into the refrigerating circuit, not shown, of an associated air conditioning system. As clearly shown in FIG. 4, the refrigerant gas flowing in the discharge pressure chamber 15 collides with the peripheral surface of each of the tubes 21 and moves along opposite lateral portions of the peripheral surface of same to reach a zone immediately downstream of the tube 21 whereupon it forms von Kármán's vortices. As known as von Kármán's theory, the Kármán's vortices formed at opposite lateral sides of the tube immediately downstream of the tube swirl and move toward each other, and accordingly the refrigerant gas in the form of vortices is guided into the recess 21*a* and temporarily stays there. Further, the presence of the recess 21*a* promotes formation of such Kármán's vortices. Such von Kármán's vortices which are successively formed become gathered in the recess 21*a* while colliding with each other so that the lubricating oil-containing refrigerant gas is then successively guided through the slit 21*b* into the interior of the tube 21 where successive groups of lubricating oil in the refrigerant gas collide with each other to become coagulated while suddenly dropping in velocity to adhere to the inner wall of the tube. Thus, the lubricating oil becomes separated and moves downward along the inner wall of the tube due to its own gravity and is stored on the bottom of the casing 1*b*. The lubricating oil thus stored on the bottom of the casing 1*b* is guided through the lubricating oil-feeding passage 17 formed in the front side block 2*b* into the annular oil groove 5*a* of the bearing portion 5 due to the high pressure in the discharge pressure chamber 15 as well as a drawing action caused by the movement of lubricating oil in the pump assembly P in unison with the rotation of the drive shaft 4, hereinafter described. The lubricating oil then lubricates the sliding surfaces of the drive shaft 4 and the bearing portion 5, and then travels through the fine gap between the drive shaft 4 and the bearing portion 5 into the back pressure chamber 3*c* to apply back pressure to the vanes 3*b* as well as to lubricate and seal the sliding surfaces of the vanes 3*b* and the rotor 3 on one hand, and into the space 24 accommodating the shaft-seal means 6 to lubricate the same means and assist the sealing action of same on the other hand. Thereafter, the lubricating oil introduced into the space 24 is guided through the oil passage 18 into the pump housing 2 to lubricate the sliding surfaces of the housing 2 and the rotor 3, and then flows into the pump working chambers 12. On the other hand, also the lubricating oil in the back pressure chamber 3*c* flows into the pump working chambers 12 through the gaps between the vanes 3*b* and the slits 3*a*. The lubricating oil thus flowing into the pump working chambers 12 is mixed into the sucked refrigerant gas and compressed together to be discharged into the discharge pressure chamber 15. The same cycle of feeding of the lubricating oil as above is repeated during the operation of the compressor.

In the lubricating oil device 20 described above, the number N of times of occurrence of von Kármán's vortices can be represented by the following equation:

$$N = St \cdot V/D$$

where

St = the Strouhal number determined as a function of the Reynolds number;

V = the flow velocity of operating fluid, i.e. compressed refrigerant in the discharge pressure chamber 15 (m/sec); and D = the outer diameter of the tube 21.

Figure 5:
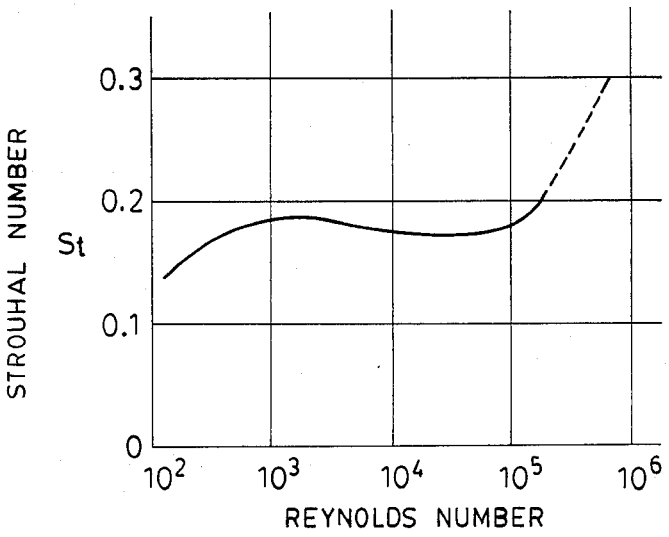
FIG. 5 is a graph showing the relationship between the Reynolds number and the Strouhal number.

For instance, in a compressor having a discharge quantity of 140 cc/rev., a discharge pressure/suction pressure ratio of 14/2 kg/cm$^2$G at 3000 rpm, and a discharge pressure chamber 15 having an inner diameter of 11.5 cm, the number of times of occurrence of von Kármán's vortices is normally about 10, if the tube 21 has an outer diameter of 8 mm. From FIG. 5 showing the relationship between the Reynolds number and the Strouhal number, it will be learned that the value of the Strouhal number lies within a small range as indicated by the solid curve in FIG. 5 while the compressor operates within its working rotational speed region. Therefore, with the oil-separating device of the invention, a sufficient number of von Kármán's vortices can occur over the whole working rotational speed region of the compressor, thereby always ensuring a stable oil-separating function. Particularly, as distinct from the aforementioned conventional types, the oil-separating device according to the invention can achieve a higher rate of oil separation in a high rotational speed region of the compressor, while securing a sufficient rate of oil separation in a low rotational speed region of the compressor, since the number of times of occurrence of von Kármán's vortices increases substantially in proportion to the flow velocity of the operating fluid or compressed refrigerant gas.

In the lubricating oil-separating device 20, the number, configuration and arrangenment of the tube 21, the recess 21*a* and the opening or slit 21*b* are not limited to those in the illustrated embodiment. For instance, a plurality of recesses may be arranged longitudinally of each of the tubes 21 or may be arranged in two or more parallel lines insofar as they ensure formation of von Kármán's vortices, and also slits may be configurated and/or arranged so as to conform to such alternative arrangement of the recess.

While a preferred embodiment of the invention has been described, variations thereto will occur to those skilled in the art within the scope of the present inventive concepts which are delineated by the following claims.

What is claimed is:

1. In a refrigerant compressor for an air conditioning system, including a pump assembly for compressing refrigerant having lubricating oil mixed therein, said pump assembly having at least one pump outlet, at least one discharge valve disposed to close and open said pump outlet, a discharge pressure chamber disposed for communication through said at least one discharge valve with said at least one pump outlet to be supplied with said refrigerant compressed by said pump assembly and discharged through said at least one pump outlet, and a discharge port communicating with said discharge pressure chamber for discharging said compressed refrigerant to the outside of said compressor therethrough, said lubricating oil mixed in said refrigerant being used for lubrication of sliding parts of said compressor, a lubricating oil-separating device mounted within said discharge pressure chamber for separating said lubricating oil from said refrigerant, said lubricating oil-separating device comprising:

a plurality of tubes substantially vertically disposed within said discharge pressure chamber, said tubes each extending in a direction traversing a flow of said compressed refrigerant discharged through said pump outlet of said pump assembly and flowing in said discharge pressure chamber toward said discharge port, said tubes each having an open lower portion, at least one recess formed in a portion of a peripheral surface thereof facing substantially downstream of said flow of said compressed refrigerant, and an opening formed in said recess and communicating with the interior of said each tube.

2. A lubricating oil-separating device as claimed in claim 1, wherein said recess extends axially of said each tube along a substantially whole length thereof.

3. A lubricating oil-separating device as claimed in claim 2, wherein said opening comprises a slit extending axially of said each tube along a substantially whole length thereof.

4. A lubricating oil-separating device as claimed in claim 1, wherein said recess has a trough, said opening being formed through said trough.

5. In a refrigerant compressor for an air conditioning system, including a pump assembly for compressing refrigerant having lubricating oil mixed therein, said pump assembly having a pump housing having an endless camming inner peripheral surface, a rotor rotatably disposed within said pump housing and having a plurality of axial slits arranged in circumferentially spaced relation, and a plurality of vanes radially slidably fitted, respectively, in said axial slits, said pump housing, said rotor and said vanes cooperating to define at least one pump working chamber therebetween, at least one pump outlet formed in said pump housing and communicating with said at least one pump working chamber on a discharge stroke, and at least one discharge valve disposed to close and open said at least one pump outlet, a casing accommodating said pump assembly, a discharge pressure chamber defined between said pump housing and said casing for communication through said at least one discharge valve with said at least one pump outlet to be supplied with said refrigerant compressed by said pump assembly and discharged through said at least one pump outlet and said at least one discharge valve, and a discharge port formed in said casing and opening in said discharge pressure chamber for discharging said compressed refrigerant to the outside of said compressor therethrough, said lubricating oil mixed in said refrigerant being used for lubrication of sliding parts of said compressor, a lubricating oil-separating device mounted within said discharge pressure chamber for separating said lubricating oil from said refrigerant, said lubricating oil-separating device comprising a plurality of tubes substantially vertically disposed within said discharge pressure chamber, and retainer means retaining said tubes in respective predetermined places within said discharge pressure chamber, said tubes each extending in a direction traversing a flow of said compressed refrigerant discharged through said pump outlet of said pump assembly and flowing in said discharge pressure chamber toward said discharge port, said tubes each having an open lower portion, at least one recess formed in a portion of a peripheral surface thereof facing substantially downstream of said flow of said compressed refrigerant, and an opening formed in said recess and communicating with the interior of said each tube.

6. A lubricating oil-separating device as claimed in claim 5, wherein said recess extends axially of said each tube along a substantially whole length thereof.

7. A lubricating oil-separating device as claimed in claim 6, wherein said opening comprises a slit extending axially of said each tube along a substantially whole length thereof.

8. A lubricating oil-separating device as claimed in claim 5, wherein said recess has a trough, said opening being formed through said trough.

9. A lubricating oil-separating device as claimed in claim 5, wherein said retainer means comprises at least one stay embracingly supporting said tubes, and screw means fixing said stay to said pump housing.

10. A lubricating oil-separating device as claimed in claim 9, wherein said stay supports at least two of said tubes arranged along said flow of said compressed refrigerant.

* * * * *